US005884976A

United States Patent [19]

Breen et al.

[11] Patent Number: 5,884,976

[45] Date of Patent: Mar. 23, 1999

[54] CHAIR SWIVEL ARM REST

[75] Inventors: William R. Breen; Paul N. Van Hatten, both of Toronto, Canada

[73] Assignee: Nightingale Inc., Mississauga, Canada

[21] Appl. No.: 19,807

[22] Filed: Feb. 6, 1998

[51] Int. Cl.[6] ..... A47C 7/54

[52] U.S. Cl. ..... 297/411.37; 297/411.35

[58] Field of Search ..... 297/411.37, 116, 297/411.35, 411.2, 411.31, 411.3

[56] References Cited

U.S. PATENT DOCUMENTS

| | | |
|---|---|---|
| 939,623 | 11/1909 | Payne et al. . |
| 3,950,027 | 4/1976 | Wilson . |
| 4,277,102 | 7/1981 | Aaras et al. . |
| 4,822,103 | 4/1989 | Stenvall . |
| 4,961,610 | 10/1990 | Reeder et al. . |
| 5,369,805 | 12/1994 | Bergsten et al. . |
| 5,380,065 | 1/1995 | Rohrer . |
| 5,393,124 | 2/1995 | Neil . |
| 5,484,187 | 1/1996 | Doerner et al. . |
| 5,590,934 | 1/1997 | Gibbs . |
| 5,641,203 | 6/1997 | Van De Riet et al. . |
| 5,651,586 | 7/1997 | Groth . |
| 5,655,814 | 8/1997 | Gibbs . |

*Primary Examiner*—Milton Nelson, Jr.
*Attorney, Agent, or Firm*—Barrigar & Moss

[57] ABSTRACT

An arm rest for a chair is disclosed that has an upper portion that swivels horizontally to support a user's forearm or wrist. The arm rest is removably attachable to a wide variety of chair arms. The arm rest includes a pair of parallel plates, one having a transverse opening therein adjacent to a forward end, and the other having a transverse shaft slidably located in the transverse opening for pivoting or swivelling the upper portion of the arm rest into a desired position. One of the plates is formed with a plurality of recesses arranged in a circle about the pivot axis, and the other plate has at least one locking pin extending into a selective recess to lock the upper swivelling arm rest portion in position. The upper arm rest portion is lifted or raised to disengage the locking pin. The swivelling arm rest portion is then rotated or swung into a desired position and released allowing the locking pin to engage another recess, again locking it in position.

15 Claims, 3 Drawing Sheets

CHAIR SWIVEL ARM REST

FIELD OF THE INVENTION

This invention relates to chair arm rests, and in particular, to arm rests that are rotatable about a vertical axis.

BACKGROUND OF THE ART

In chair constructions, it is highly desirable that the chair arms or arm rests be adjustable to suit the physical characteristics of different persons who may use any given chair. Usually, the chair arms, or arm rests mounted on chair arms, are moveable vertically or laterally. Sometimes, such as in dental chairs, it is also desirable to have the arm rests swing sideways or vertically out of the way to facilitate entry and exit from the chairs.

In recent times, with so much time being spent typing on keyboards at computer terminals and the like, a lot of concern has arisen about the need to properly support a person's forearms or wrists during such activities. One proposal for addressing this concern is illustrated in U.S. Pat. No. 5,380,065 issued to Daniel F. Rohrer. This patent shows the use of a mechanical linkage to have the padded portion of the arm rest swing in a horizontal plane to get the desired position adjustment. Another proposal is shown in U.S. Pat. No. 5,393,124 issued to Gary K. Neil wherein a padded portion of an arm rest swings inwardly about a vertical axis. A difficulty with these and other prior art approaches to the problem is that there is no solid locking mechanism to hold the moveable arm rest portions in position. Either a friction or pressure mechanism, such as in the Rohrer patent, or a ball detent type mechanism, such as in the Neil patent, is used, and these are unsatisfactory because they do not have enough holding power to prevent the arm rests from moving inadvertently. In fact, these prior art devices can actually be dangerous, because persons usually lean heavily on the arm rests when getting into and out of chairs, and if the arm rests move unexpectedly, this could cause the person to fall resulting in an injury.

In the present invention, a movable arm rest portion is positively locked in position by having at least one locking pin securely located in a transverse recess, so that downward or sideways pressure on the arm rest cannot cause it to move unexpectedly.

SUMMARY OF THE INVENTION

According to the invention, there is provided an arm rest for a chair comprising a first plate having a transverse opening therethrough and a second plate located parallel to the first plate and having a transverse shaft slidably located in the transverse opening to permit transverse and swivel movement between the first and second plates. One of the first and second plates has a transverse locking pin spaced laterally from the shaft. The other of the first and second plates has a plurality of spaced-apart, transverse recesses arranged in a circle concentrically about the shaft and adapted to receive selectively the locking pin and prevent swivel movement between the plates. The locking pin is shorter in length than the transverse shaft, so that upon transverse separation of the plates, the locking pin is disengaged from a selective recess allowing swivel movement between the plates. One of the plates includes means for attachment to a chair arm, and the other of the plates includes means forming an arm support surface.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
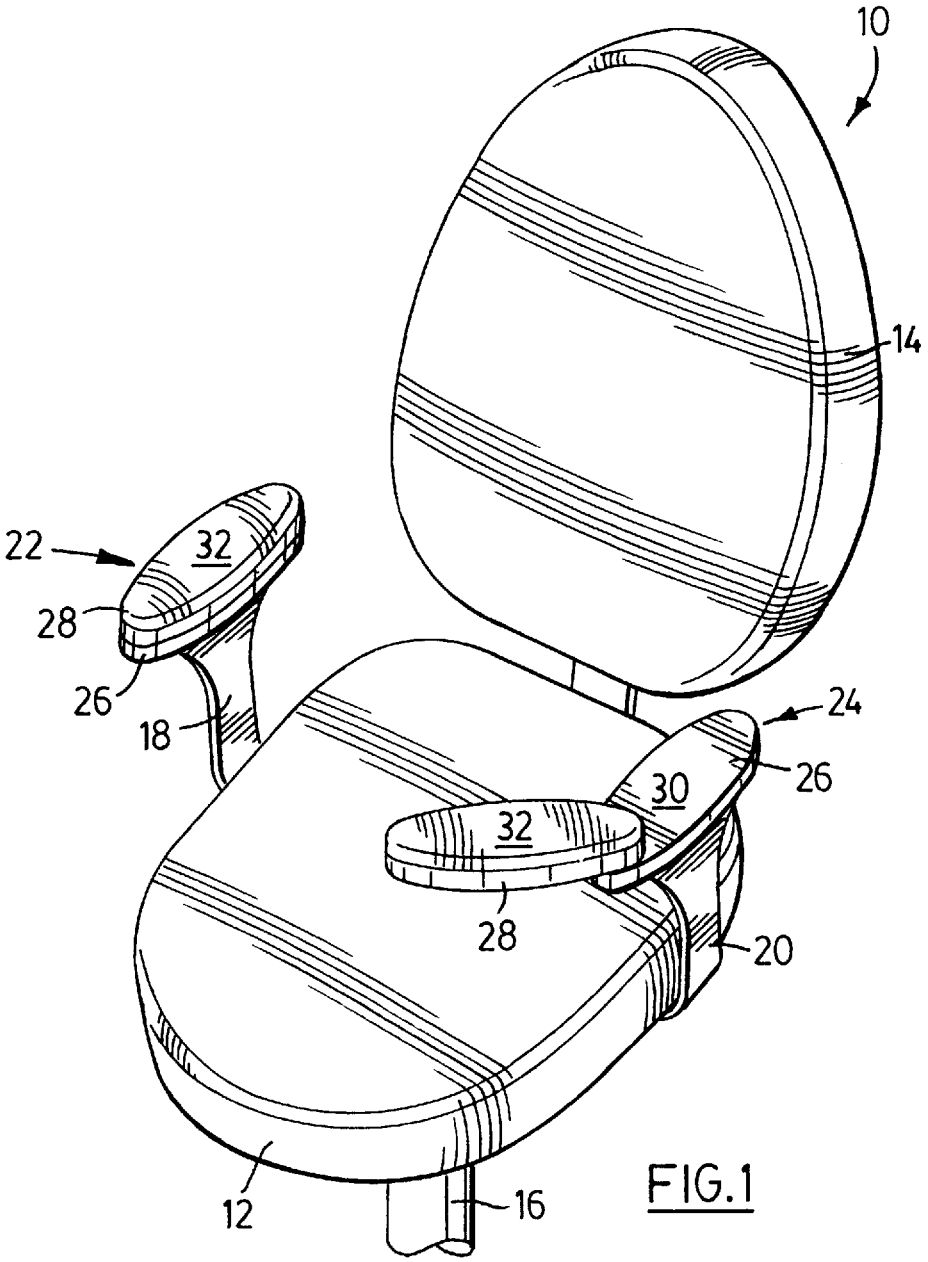
FIG. 1 is a perspective view of a chair employing a preferred embodiment of an arm rest according to the present invention.

Referring firstly to FIG. 1, a typical office chair is generally indicated by reference numeral 10. Chair 10 includes a seat 12, a chair back 14 and a pedestal base 16. It will be appreciated that the chair itself is not part of the present invention. Any type of chair could be used with this invention, whether it has a pedestal base or legs, and whether or not the seat and back are formed of separate pieces or one piece, or the like.

Chair 10 has arms 18 and 20 and these arms have mounted thereon preferred embodiments of arm rests 22, 24 according to the present invention. The arms 18, 20 may or may not be part of the present invention depending upon how they are connected or attached to arm rests 22, 24. In most cases, the arms 18, 20 are conventional and arm rests 22, 24 are configured to be replacement parts for standard fixed arm rests that come with these types of chairs. For these reasons, arms 18, 20 will not be described in further detail herein and neither will the other parts of chair 10. It should be mentioned, also, that arms 18, 20 often come with some type of height adjustment mechanism, but this has not been shown in the drawings for the purposes of clarity. Similarly, chair seat 12 and back 14 are usually adjustable either as to height, angle or spacing therebetween. Again, since these features are not part of the present invention, they will not be described further herein.

Arm rests 22, 24 include a lower fixed portion 26, and an upper swivel or pivoting portion 28 that swivels or rotates horizontally about fixed portion 26. Fixed and swivel portions 26, 28, are formed of integral skinned or self-skinning polyurethane foam with embedded metal plates, as will be described further below. It is these plates that provide the swivel and locking mechanism for arm rests 22, 24. It will be appreciated, however, that the foam on both the fixed and swivel portions 26, 28 form respective upwardly facing padded arm support surfaces 30, 32. Therefore, a person's elbows could be supported on fixed portions 26, and the person's forearms or wrists could be supported on swivel portions 28.

Figure 3:
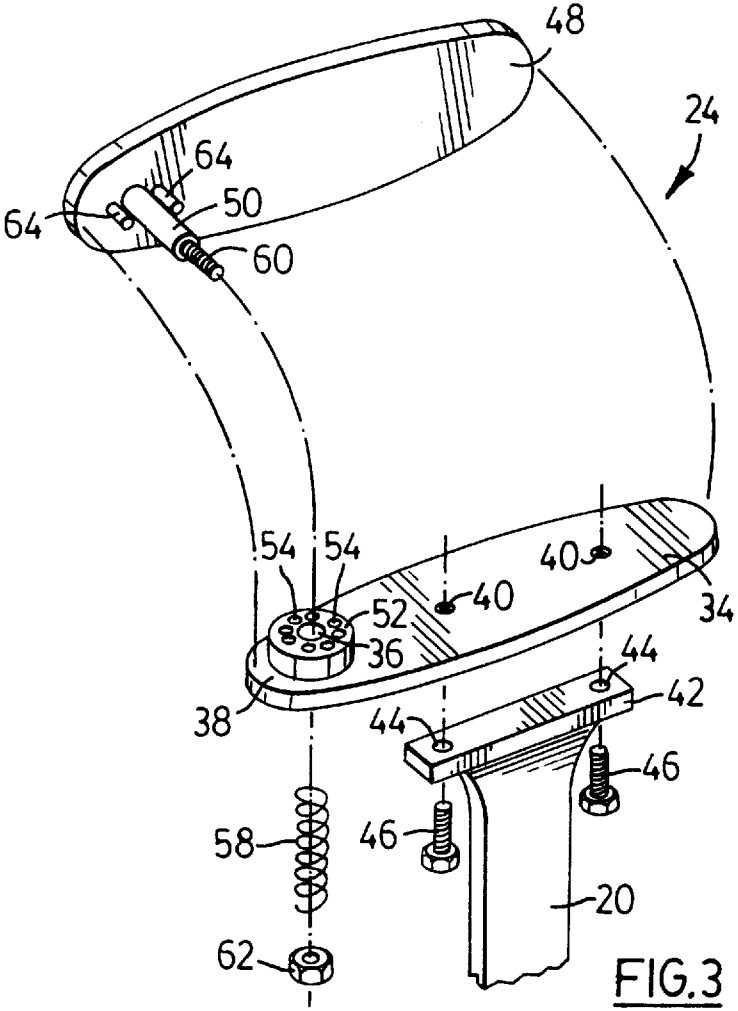
FIG. 3 is an exploded perspective view of the arm rest as shown in FIG. 2.
Figure 2:
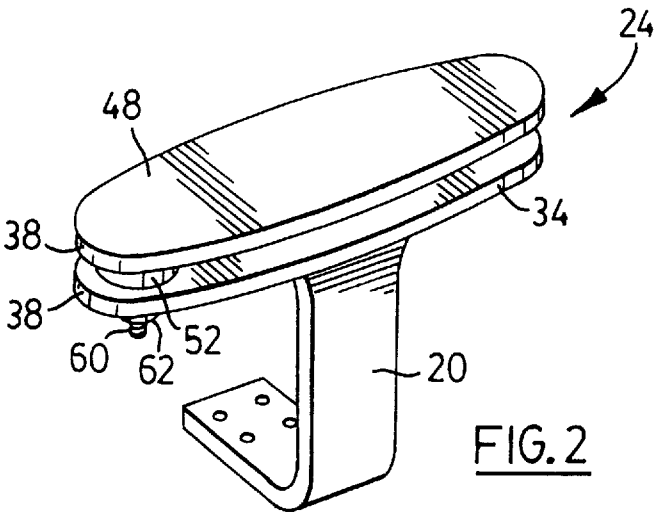
FIG. 2 is a perspective view of the chair arm shown in FIG. 1 with the foam padding removed from the arm rest portion of the chair arm.
Figure 4:
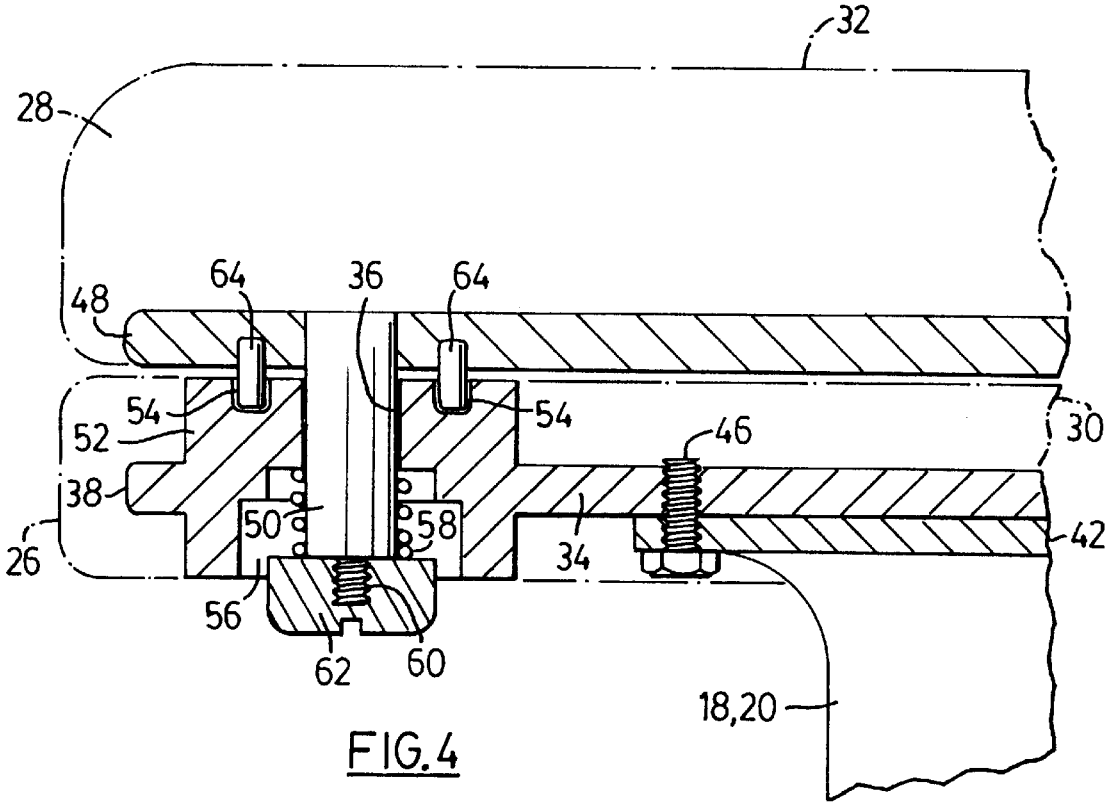
FIG. 4 is an enlarged vertical sectional view of the arm rest with the foam padding portion shown in chain dotted lines.

Referring next to FIGS. 2, 3 and 4, the urethane foam padding has been removed in FIGS. 2 and 3 and shown in chain dotted lines in FIG. 4 for the purposes of illustration. In FIGS. 2 and 3, arm 20 and arm rest.24 is shown, but it will be appreciated that the same components would form arm 18 and arm rest 22 simply by reversing the orientation as shown in FIGS. 2 and 3 of either arm 20 or arm rest 24. The description of arm rest 24, therefore, applies equally to arm rest 22, so the same reference numerals will apply to both arm rests.

Arm rest 24 includes a first plate 34 having a transverse opening 36 therethrough located adjacent to a distal end portion 38 of first plate 34. First plate 34 includes a pair of spaced-apart threaded holes 40 which form means for attachment of arm rest 24 to arm 20, or vice-versa. Arm 20 has an upper flange 42 with holes 44 therethrough, the latter accommodating bolts or cap screws 46, the latter passing through holes 44 and being threaded into holes 40 to attach arm 20 to first plate 34 and thus arm rest 24.

As mentioned above, if arm 20 is conventional or standard, threaded holes 40 can be sized and located to suit, so that arm rest 24 can replace the standard arm rest that came with the chair. Alternatively, arm 20 could be attached permanently to first plate 34, so that the entire arm 20 and arm rest 24 would come as an integral unit, but this integral unit again could be used to replace the standard arms on most chairs, or be added to chairs that do not already have arms.

Arm rest 24 also has a second plate 48 located parallel to and directly above first plate 34. Second plate 48 has a transverse shaft 50 slidably located in transverse opening 36 to permit transverse and axial movement of second plate 48 relative to first plate 34, as well as swivel or pivoting movement between first and second plates 34, 48.

As seen best in FIGS. 3 and 4, first plate 34 has an annular end boss or flange 52 that defines transverse opening 36. End boss 52 also defines a plurality of spaced-apart, transverse recesses 54 arranged in a circle concentrically about transverse opening 36. Preferably, there are 12 equi-spaced recesses 54 arranged around the circle, although fewer or more recesses 54 could be provided as desired, and depending upon the size of end boss 52. End boss 52 is shown in FIG. 4 as being integrally formed as part of first plate 34 for purposes of clarity, but end boss 52 is preferably a separate annular flange-like member securely mounted in first plate 34 by welding or similar means. End boss 52 also has a lower recess 56 to accommodate a spring 58 located on transverse shaft 50. Transverse shaft 50 also has a threaded distal end portion 60 and a nut or cap 62 is removably mounted on distal end portion 60 to prevent shaft 50 from coming totally out of transverse opening 36 as shaft 36 is moved upwardly to adjust the position of swivel portion 28, as will be described further below.

Second plate 48 also has at least one, and preferably a pair, of opposed transverse locking pins 64 spaced laterally from transverse shaft 50. Locking pins 64, as well as shaft 50 are securely located in second plate 48. Pins 64 are normally press fitted in place and shaft 50 is normally secured by welding. It will be appreciated that since transverse recesses 54 are located in a circle and recesses 54 receive pins 64, pins 64 are spaced from the axis of shaft 50 a distance equal to the radius of the circle of transverse recesses 54. Pins 64 are diametrically opposed about the axis of shaft 50.

Figure 5:
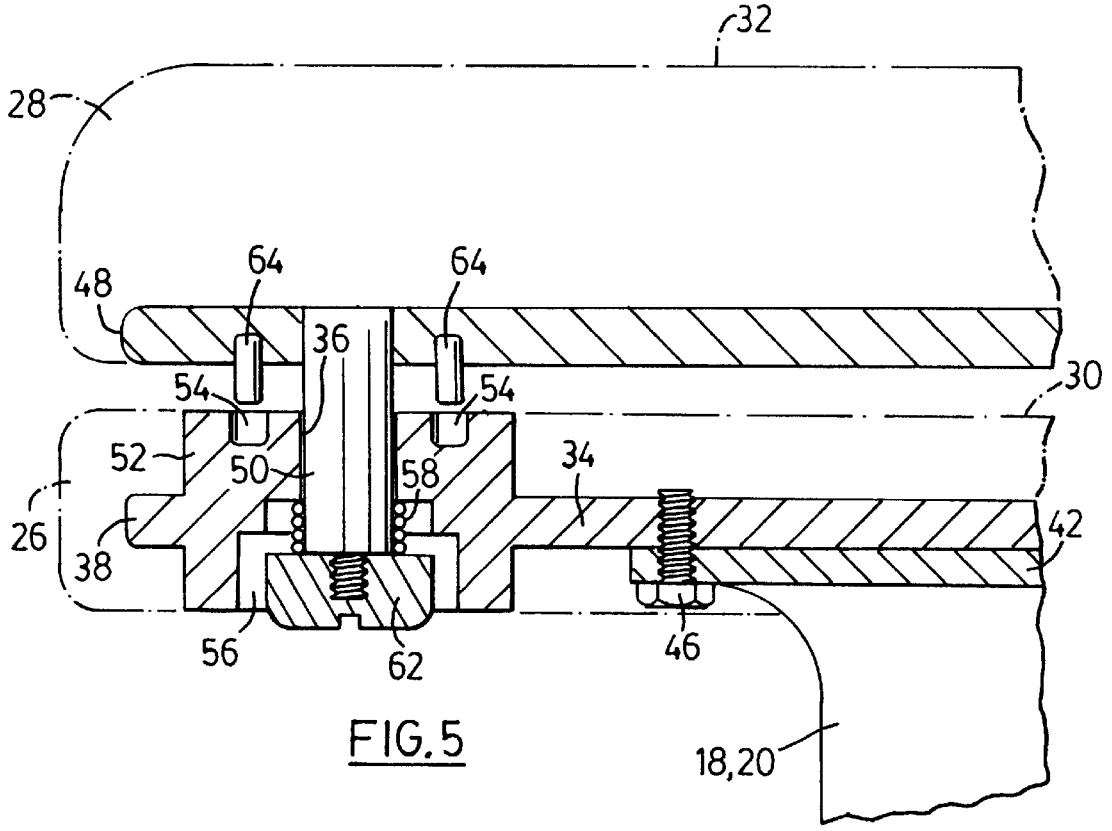
FIG. 5 is a vertical sectional view similar to FIG. 4, but showing the arm rest portions separated so as to allow swivel or pivotal movement.

Referring next to FIGS. 4 and 5, it will be seen that to adjust the position of upper swivel portion 28, swivel portion 28 just needs to be moved upwardly until transverse locking pins 64 are disengaged from recesses 54, as seen in FIG. 5. Swivel portion 28 can then be swung or pivoted into any desired position, such as shown in FIG. 1, and swivel portion 28 released allowing locking pins 64 to be selectively received in another set of recesses 54, securely locking swivel portion 28 in place. Because there are twelve recesses 54 in the preferred embodiment, the position of swivel portion 28 can be adjusted at 30 degree intervals. The adjustment angle can be varied, however, simply by changing the number and location of recesses 54. Swivel portion 28 can be raised either by grasping it and lifting it upwardly, or by pressing from the underside upwardly on cap 62, as desired. Spring 58 urges first and second plates 34, 48 together and locking pins 64 into engagement with recesses 54. However, it will be appreciated that spring 58 could be eliminated if pins 64 and recesses 54 are made of sufficient length or depth to prevent the accidental disengagement of pins 64 from recesses 54.

It should also be noted that because the diameter of the circle of recesses 54 is smaller than the width of plates 34, 48, the locking mechanism of arm rests 22, 24 is not visible in use.

Having described preferred embodiments of the invention, it will be appreciated that various modifications may be made to the structures described above. For example, transverse shaft 50 and transverse opening 36 could be located in different positions in plates 34, 48 if some particular positioning of upper swivel portion 28 were desired. Rather than embedding plates 34, 48, in polyurethane foam, some other material could be used to cover the plates. For example, it may be desirable to cover the upper or second plate 48 with wood to provide a wooden arm rest, or the upper and lower plates could be covered with upholstery. End bosses 52 are not necessary. Recesses 54 and transverse opening 36 could just be formed in a plane flat first plate 34 with perhaps a washer being located on transverse shaft 50 between plates 34, 48. In this case, it would not be possible to achieve a significant padded arm support surface 30 on the upper side of first plate 34.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An arm rest for a chair, comprising:

a first plate having a transverse opening therethrough; a second plate located parallel to the first plate and having a transverse shaft slidably located in said transverse opening to permit transverse and swivel movement between the first and the second plates; one of the first and second plates having a transverse locking pin spaced laterally from the shaft; the other of the first and second plates having a plurality of spaced-apart, transverse recesses arranged in a circle concentrically about the shaft and adapted to receive selectively the locking pin and prevent swivel movement between said plates; the locking pin being shorter in length than the transverse shaft, so that upon transverse separation of the plates, the locking pin is disengaged from a selective recess allowing swivel movement between the plates; one of the plates including means for attachment to a chair-arm; and the other of the plates including means forming an arm support surface.

2. An arm rest as claimed in claim 1 wherein the first plate has twelve of said transverse recesses equi-spaced around said circle.

3. An arm rest as claimed in claim 1 and further comprising a chair arm attached to one of said plates by said attachment means, said chair arm including means for attachment thereof to a chair.

4. An arm rest as claimed in claim 1 wherein said circle has a diameter less than the width of the first and second plates.

5. An arm rest as claimed in claim 1 wherein the transverse opening and transverse shaft are located adjacent to respective distal end portions of the first and second plates.

6. An arm rest as claimed in claim 1 wherein the first and, second plates are embedded in integral skinned polyurethane foam, said foam forming the arm support surface.

7. An arm rest as claimed in claim 6 wherein the foam on both the-first and second plates forms upwardly facing arm support surfaces on both the first and second plates.

8. An arm rest as claimed in claim 1 wherein the shaft has a central axis, and wherein the locking pin is spaced from the axis of the shaft a distance equal to the radius of the circle of transverse recesses.

9. An arm rest as claimed in claim 8 wherein the locking pin is a first locking pin, and further comprising a second identical locking pin located diametrically opposed to the first locking pin.

10. An arm rest as claimed in claim 1 wherein the second plate has the transverse locking pin, the first plate being formed with the plurality of spaced-apart transverse recesses.

11. An arm rest as claimed in claim 10 wherein the first plate includes a plurality of spaced-apart threaded holes forming the means for attachment to a chair arm.

12. An arm rest as claimed in claim 11 wherein the threaded holes are located to mount the first plate horizontally on the chair arm, the second plate thus swivelling horizontally about the first plate.

13. An arm rest as claimed in claim 1 wherein the transverse shaft extends through and beyond the transverse opening, the transverse shaft having a distal end portion; and further comprising a cap removably mounted on said distal end portion to prevent the shaft from coming totally out of the transverse opening.

14. An arm rest as claimed in claim 13 and further comprising a spring located between the cap and the first plate for urging the first and second plates together.

15. An arm rest as claimed in claim 14 wherein said spring is a coil spring located on the transverse shaft.

* * * * *